United States Patent [19]

Christian

[11] 4,382,499

[45] May 10, 1983

[54] NOVEL TOTALIZER APPLICATION FOR NEWSPAPER VENDING MACHINE

[76] Inventor: Donald K. Christian, 119 Woodbine Ter., Spartanburg, S.C. 29301

[21] Appl. No.: 226,018

[22] Filed: Jan. 19, 1981

[51] Int. Cl.[3] ..... G07F 5/08

[52] U.S. Cl. ..... 194/1 L; 194/92

[58] Field of Search ..... 194/1 L, 94, DIG. 3, 194/92, 93

[56] References Cited

U.S. PATENT DOCUMENTS

| | | |
|---|---|---|
| 2,925,898 | 2/1960 | Terry . |
| 3,174,608 | 3/1965 | Knickerbocker . |
| 3,464,530 | 9/1969 | Knickerbocker . |
| 3,738,466 | 6/1973 | Knickerbocker . |
| 3,804,223 | 4/1974 | Voegeli . |
| 3,882,984 | 5/1975 | Knickerbocker . |
| 3,946,848 | 3/1976 | Knickerbocker . |
| 4,000,799 | 1/1977 | Knickerbocker . |
| 4,033,442 | 7/1977 | Wirstlin et al. ..... 194/1 L X |
| 4,037,701 | 7/1977 | Knickerbocker ..... 194/1 L |
| 4,049,106 | 9/1977 | Chalabian . |

*Primary Examiner*—F. J. Bartuska

[57] ABSTRACT

A novel arrangement for using a standard totalizing coin mechanism in a newspaper vendor is disclosed. Instead of using a coin or stack of coins to depress a door latch as is now customary to permit access to a stack of papers, the present invention uses a pivotally mounted finger for this purpose. Whereas heretofore ratchet-like pawls have been used to restrict the upward motion of coins resulting in the depression of a door latch, the present invention uses a price cam affixed to a totalizer that in turn restricts the upward motion of the pivotally mounted finger to accomplish this function. Also disclosed are ways of resetting a totalizer and a dual price cam.

6 Claims, 5 Drawing Figures

NOVEL TOTALIZER APPLICATION FOR NEWSPAPER VENDING MACHINE

BACKGROUND OF THE INVENTION

The merchandising of newspapers through vending machines has developed through many and varied methods and apparatuses beginning well before the turn of the century as evidenced by U.S. Pat. No. 464,067 granted to M. H. Foster in 1891 and culminating temporarily with the up-to-now generally satisfactory conventional semi-honor newspaper vendors wherein a purchased inserts certain coins in certain slots thus providing for the release of a door giving access to an area wherein a multiplicity of newspapers are contained for distribution to whomever may gain access thereto.

Customarily each of a multiplicity of coin slots is connected to a vertical channel in such manner that all the coins inserted in said slot stack up one upon another. These various stacks of coins are supported on the bottom by a spring loaded door latch in such manner that initial movement of the latch will cause the coins to rise within said vertical channel. As an attempt is made to rotate the door outwardly, said door latch will engage a rigid catch thus obstructing entry. Pawls are provided at strategic positions along the vertical channel where by a pre-determined stack of coins may be restrained from rising when an attempt is made to rotate the door outward, thus forcing said spring loaded door latch downward to a position wherein it will not engage said rigid catch permitting the door to continue rotating to a position of access. In this instance, coins are discharged from the vertical channel as door latch is removed from its position of support.

These techniques are taught by U.S. Pat. Nos. 2,925,898 Terry; 3,174,608 and 3,464,530 Knickerbocker; 3,804,223 Voegeli; 3,884,330 and 4,049,106 Chalabian. In all applications, provision is made for a dual price selection to accommodate the daily/Sunday price differential. As long as the price of the papers remained where they could be purchased for not more than two or three coins, these mechanisms were quite satisfactory. With the current price of newspapers—65 cents in one U.S. city and $1.15 in another—this type of coin sensing is rapidly becoming obsolete.

Many quite satisfactory totalizing multi-price coin mechanisms have been developed throughout the vending industry as evidenced by U.S. Pat. No. 4,143,749 which will accept any combination of coins, and vend various products at various prices, but heretofore no acceptable means has been found to use standard vending mechanisms to release the door latch of semi-honor newspaper vendors. They have all proven too expensive, too large, unsuitable for use in outside environments or any one of a variety of other reasons.

Attempts have been made to develop dual price mechanical coin mechanisms, specifically for newspaper vendors as is evidenced by U.S. Pat. Nos. 3,738,466; 3,882,984; 3,946,848; 4,000,799 and 4,037,701 Knickerbocker. These attempts have met with very limited success. The complexity of the mechanisms which tends to inhibit field servicability and the capital investment required to manufacture this type mechanism economically in light of the fact that they have limited application out of the newspaper industry tend to render them impractical.

SUMMARY OF THE INVENTION

It is the object of the present invention to provide a semi-honor newspaper vendor that will accept any combination of coins that total the predetermined selling price of a paper on any given day.

It is further the object of the present invention to reduce to one, the slots that must be provided to receive coins in a semi-honor newspaper vendor.

It is the object of the present invention to provide a novel means of using a standard vending totalizer to control the door opening of a semi-honor newspaper vendor.

A further object of the present invention is to provide a readily selectable dual price system for use with the above mentioned totalizing newspaper vendor.

Generally speaking, the present invention relates to a machine for the vending of newspapers combining a housing wherein is placed a supply of newspapers to be vended, a door for closing said housing, a latch attached to said door, a catch for securing said latch, and an upper enclosure to contain said catch, and a coin totalizing mechanism so oriented as to release said latch from said catch upon the proper insertion of coins thereinto.

More specifically, a pivotally mounted member is provided to come in contact with a door latch in the same manner, and, replacing the coin which comes in contact with door latch in the conventional vendor heretofore described. A rotating cam is affixed to a standard mechanical vending totalizer such as a National Rejector's model 13-03-058 S.C.S. module. Said totalizer is positioned over the above mentioned coin replacing pivotally mounted member in such manner that its rotating cam, upon insertion of a predetermined total of coinage, will impede the upward motion of this pivotally mounted member thus serving the same purpose as, and replacing the pawls of the heretofore mentioned conventional vendor. The purpose thereof: preventing the latch from engaging with the catch as the door is rotated outwardly. Said rotating cam is provided with two sets of orientation devices so that it may be readily oriented to require a small or, at the service person's option, a larger total of coins to release the door on a week day or a Sunday, as the case may be.

DESCRIPTION OF PREFERRED EMBODIMENTS

Preferred embodiments of the present invention will now be specifically described, making reference to the Figures.

Figure 1:
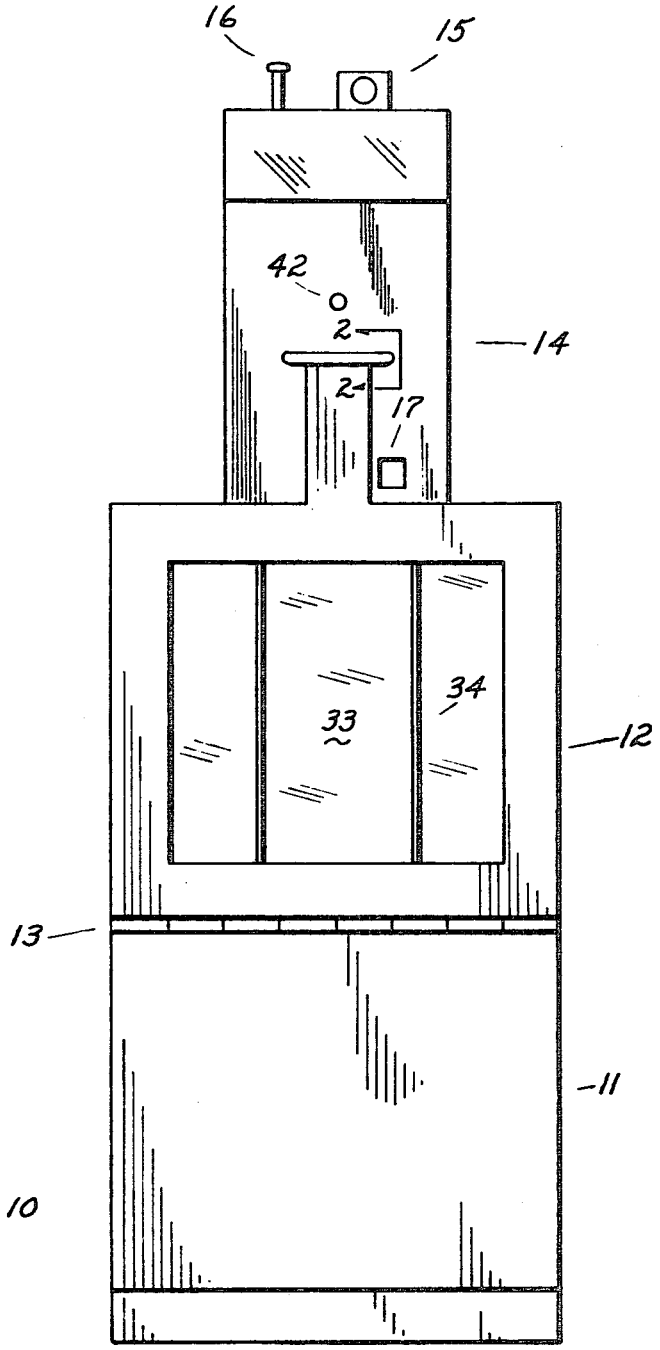
FIG. 1 is a front view of a semi-honor newspaper vendor

In reference to FIG. 1, vendor 10 is comprised of housing 11, door 12 which is pivotally mounted to said housing by means of spring hinge 13, and upper enclosure 14. Said upper enclosure contains coin insert 15, coin return button 16, coin return chute 17 and locking device 42. Said door contains window 33 and display paper rack 34.

Figure 2:
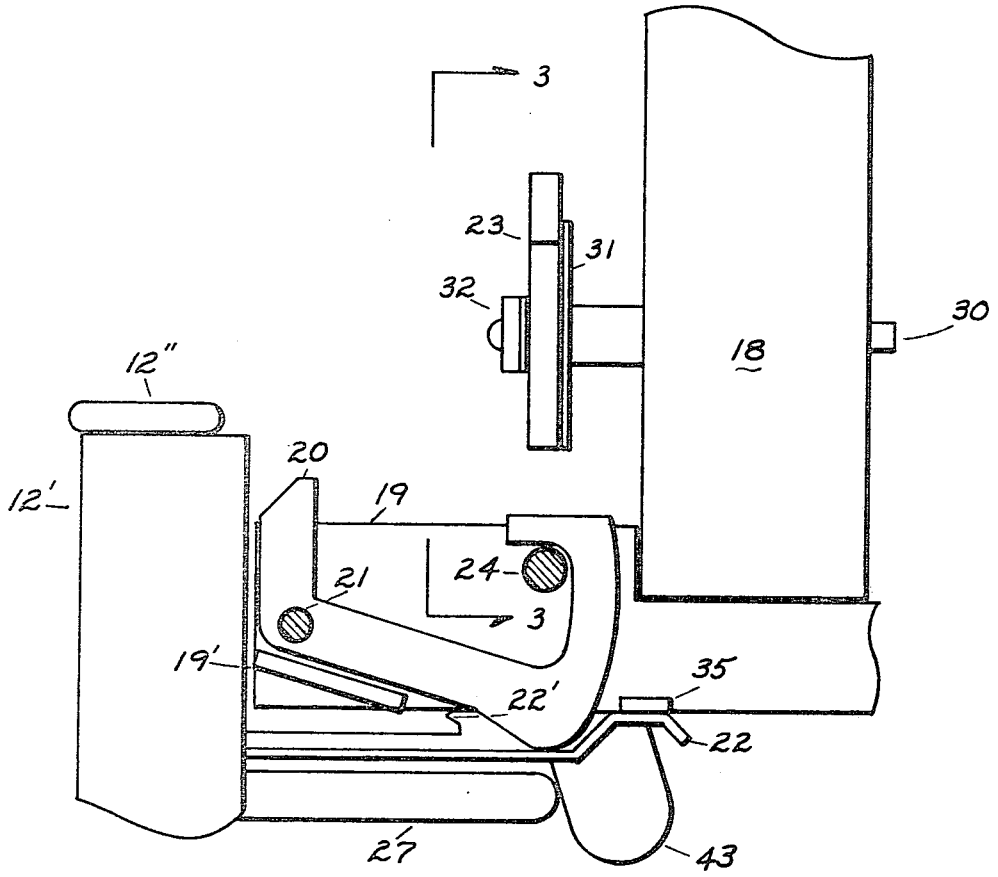
FIG. 2 is a cross-sectional view taken along line 2—2 of FIG. 1.

In reference to FIG. 2, contained within and affixed to said upper enclosure are standard mechanical vending totalizer 18 and catch assembly 19. Finger 20 is pivotally mounted in catch assembly 19 by means of shaft 21, in turn secured to catch assembly 19. Said finger rests on spring loaded latch 22 generally underneath price cam 23 and back-up plate 31 which is mounted on main shaft 30 of totalizer 18. Spring loaded latch 22, being pivotally mounted within door extention 12′ is restrained from its upward travel by latch depressor 35. When coins are inserted in coin insert 15, totalizer module 18, by means not shown but well known to those skilled in the art, separates good coins from bad coins, slugs and the like conducting rejected items to coin return chute 17. Coin return button 16 is provided to help purge rejected objects from said totalizer module. Such good coins as may be inserted are so separated and conveyed as to cause discrete increments of clockwise rotation of price cam 23, back-up plate 31 and main shaft 30. For example, one specific model of standard totalizer rotates 9° for each good nickel it senses, 18° for each good dime it senses and 45° for each good quarter it senses. In reference to both FIG. 2 and FIG. 3. If door extension 12′ is pulled outward by means of handle 12″, both integral parts of door 12, spring loaded latch 22 moves causing finger 20 to rise as it pivots about shaft 21, thus permitting said latch to rise engaging latch hook 22′, an integral part of latch 22, in catch 19′ which in turn is affixed to catch assembly 19 thereby preventing door 12 from giving access to the newspapers contained within housing 11.

Figure 4:
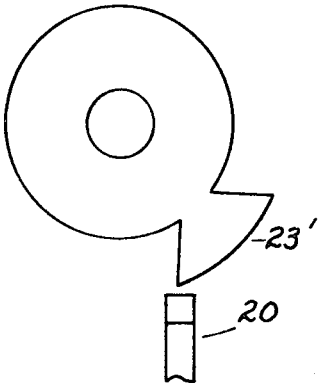
FIG. 4 is a partial view in the same plane as FIG. 3.

In reference to FIG. 4 wherein lobe 23′ of price cam 23 has been rotated to a position generally above and in the upward path of finger 20, door 12 will be permitted to open as finger 20 is restrained by lobe 23′ from rising thus forcing latch 22 downward in such manner that hook 22′ cannot engage catch 19′.

Figure 3:
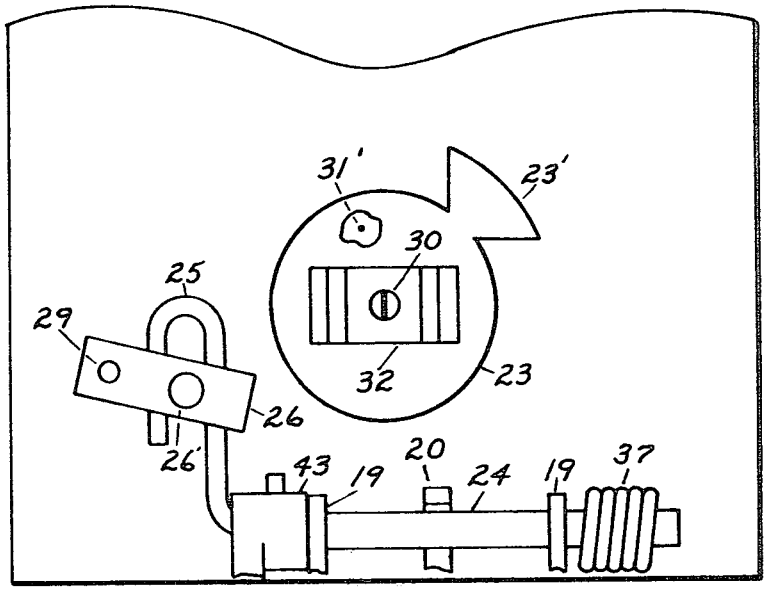
FIG. 3 is a fragmentary view of the cam and reset lever of a totalizer taken generally along line 3—3 of FIG. 2.
Figure 5:
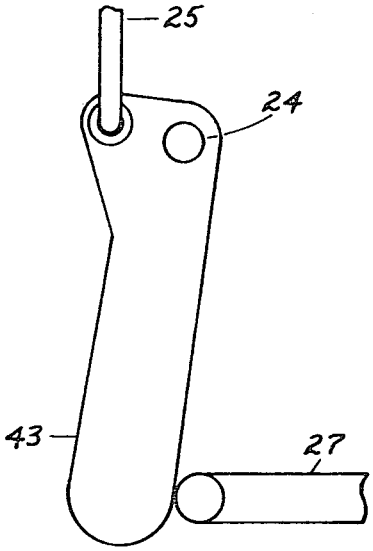
FIG. 5 is a side elevational view of the reset lever.

In reference to FIGS. 2, 3, and 5, reset lever 43 rigidly affixed to shaft 24 is urged in a counter-clockwise fashion by spring 37. Linkage 25 is pivotally engaged with said reset lever and, by its upper loop, restrained in a position of possible contact with pin 26′, and integral part of reset arm 26. Rigid member 27, being affixed to door 12 in such manner that when said door is closed said rigid member bearing on reset lever 43 causes linkage 25 to be elevated above its position of engagement with pin 26′. As good coins pass through totalizer 18, price cam 23 rotates in a clockwise manner and reset arm 26 in a counter-clockwise manner. When sufficient rotation has been induced to permit the heretofore described door release and opening, rigid member 27 is removed from its position of contact with reset lever 43. Spring 37causes clockwise rotation of shaft 24 in FIG. 2 or counter-clockwise motion as viewed in FIG. 5. Linkage 25 is brought into forceful contact with pin 26′ causing reset arm 26 to pivot downwardly about journal 29. Said reset arm is so interconnected within standard totalizer 18 that clockwise rotation thereof induces counter-clockwise motion of main shaft 30 and price cam 23 and a process best described as "resetting" is effected. Fixed stops are provided to restrict said motion when price cam 23 has been returned to a predetermined position or start point, thus readying totalizer 18 for the next sale cycle.

As door 12 is permitted to close by means of spring loaded hinge 13, rigid member 27 again is brought in contact with reset lever 43 resulting in the disengagement of pin 26′ and linkage 25 freeing reset arm 26 to rise in concert with the next rotation of price cam 23.

Again in reference to FIGS. 2 and 3, back-up plate 31 is provided with appendage 31′, an integral part thereof. The back side of price cam 23 is provided with two indentations (not shown), either of which will mate with appendage 31′. Price cam 23 is constructed in such manner that it is free to slide away from back-up plate 31 and spring 32 is provided to maintain contact between said back-up plate and said price cam. Heretofore mentioned fixed rotational stop and one of the indentations in the back of price cam 23 are so oriented that coins equaling a predetermined daily selling price will be required to advance lobe 23′ to a position wherein door 12 will be permitted to open. Another of said indentations is so oriented that a predetermined Sunday selling price will be required to advance said lobe to a position wherein said door will be permitted to open. A service person may, with an initial outward motion, rotate price cam 23 until appendage 31′ engages with the other indentation in said price cam thus changing the value of coins required to permit the opening of door 12. The above mentioned function may be accomplished with a single appendage and two indentations as described or it may be accomplished with a multiplicity of appendages engaging a multiplicity of indentations provided for any single price setting.

While the operation of a rotating mechanical totalizer has been described in the preferred embodiments, it is to be understood that a mechanical, electro-mechanical or electronic totalizer activating either a rotary, reciprocating or oscillating price cam will perform a like function.

It is further understood that the resetting process is not dependent upon spring action but can well be accomplished by the engaging of a door mounted hook behind a reset lever.

Having described the present invention in detail, it is obvious that one skilled in the art will be able to make modifications and variations thereto without departing from the scope of the invention. Accordingly, the scope of the present invention should be determined by the claims appended hereto.

What is claimed is:

1. A novel door release means for a newspaper vendor of the type which includes a door which must be opened to gain access to the newspapers comprising:

(a) a spring biased latch including a catch engaging member;

(b) a catch which when engaged by said latch prevents opening of said door;

(c) a moveable element so positioned as to selectively permit or prevent said latch from following a path of engagement with said catch;

(d) a latch depressing means to restrain said catch engaging member in a plane of non-engagement with said catch as said door starts to open; and (e) a coin mechanism including a price cam, said price cam being moveable from a position of nonrestraint to a position of restraint relative to said moveable element responsive to the insertion of money into said coin mechanism; said moveable element being so positioned in relation to said latch that said catch engaging member is permitted to move from said plane of non-engagement with said catch to engage said catch as said door starts to open when a predetermined amount of money has not been inserted or, restrain said catch engaging member in said plane of non-engagement with said catch as said door starts to open when a predetermined amount of money has been inserted in said coin mechanism.

2. A novel door release means as defined in claim 1 wherein said moveable element is pivotally mounted.

3. A novel door release means as defined in claim 1 wherein said moveable element is restrained on a generally vertical path.

4. A novel door release means as defined in claim 1 wherein said price cam is rotatably associated with said coin mechanism.

5. A novel door release means as defined in claim 2 wherein said price cam is rotatably associated with said coin mechanism.

6. A novel door release means as defined in claim 5 wherein said coin mechanism incorporates a totalizer.

* * * * *